US006491387B1

(12) United States Patent
Mayfield

(10) Patent No.: US 6,491,387 B1
(45) Date of Patent: Dec. 10, 2002

(54) INK JET CLEANING METHOD AND APPARATUS UTILIZING VACUUM IMPREGNATION AND CENTRIFUGE

(76) Inventor: Rodney Bruce Mayfield, 6707 W. 80th St., Overland Park, KS (US) 66204

( * ) Notice: Subject to any disclaimer, the term of this patent is extended or adjusted under 35 U.S.C. 154(b) by 115 days.

(21) Appl. No.: 09/664,155

(22) Filed: Sep. 18, 2000

(51) Int. Cl.[7] ..... B41J 2/17; B08B 5/04
(52) U.S. Cl. ..... 347/84; 134/21
(58) Field of Search ..... 347/84, 85, 86, 347/87; 134/21, 42, 25.1

(56) References Cited

U.S. PATENT DOCUMENTS 4,362,572 A * 12/1982 Wallace ..... 134/18
4,824,487 A * 4/1989 Heffernan ..... 134/10
4,883,542 A * 11/1989 Voneiff ..... 134/21
4,966,480 A * 10/1990 Watanabe et al. ..... 401/134
5,114,496 A * 5/1992 Bordunov et al. ..... 134/13
5,240,506 A * 8/1993 Liers et al. ..... 134/1
5,683,520 A * 11/1997 Edgett et al. ..... 134/22.19
5,707,456 A * 1/1998 Komplin et al. ..... 134/22.18
5,786,829 A * 7/1998 Pasciak et al. ..... 347/28
5,790,147 A * 8/1998 Hensel ..... 347/28
6,273,103 B1 * 8/2001 Enz et al. ..... 134/22.11
6,342,105 B1 * 1/2002 Yano et al. ..... 134/42
6,422,249 B1 * 7/2002 Certa et al. ..... 134/168 R

* cited by examiner

*Primary Examiner*—Judy Nguyen

(57) ABSTRACT

The present invention is directed toward a method of cleaning an ink jet cartridge assembly and an apparatus for use in such method. The method broadly includes the preparation of ink jet cartridges for vacuum impregnation of heated cleaning solvent and use of centrifugal force to void the cartridge of solvent, ink residue and other waste sediment. During the vacuum impregnation sub-process the heated solvent boils at a lower temperature where internal agitation and turbulence inside the otherwise sealed ink jet cartridge housing causing dried ink and other residue in the ink reservoir foam pads, internal ink paths and print head assembly to return to liquid state and be discharged upon centrifugation. The invention also comprises apparatus to perform vacuum impregnation at proper pressure, spin plates to secure ink jet cartridge housing without damaging ink reservoir foam pads as pin block their discharge and optimum revolution speed can be monitored.

1 Claim, 5 Drawing Sheets

INK JET CLEANING METHOD AND APPARATUS UTILIZING VACUUM IMPREGNATION AND CENTRIFUGE

BACKGROUND OF INVENTION

Ink jet recording assemblies have been used for decades to record indicia on a recording medium, such as paper. A typical ink jet recording assembly broadly includes a printer unit and an ink jet cartridge assembly operatively coupled with the printer unit. The cartridge assembly contain a quantity of ink for printing the indicia. In use, the printer unit receives a piece of paper and causes the cartridge assembly to move transversely across the paper between an extended position and a retracted, parked position to print ink on the paper in the form of indicia.

Ink jet cartridge assemblies commonly include a body having an ink reservoir and a head assembly. The head assembly includes an integrated circuit heater, a plurality of ink cups, and a plurality of nozzle openings formed through a nozzle plate. The nozzle openings are positioned beneath the ink cups for printing indicia.

Ink jet print cartridges assembly manufactured by various manufacturers includes a nozzle plate having numerous nozzle openings and additional air openings. The bleed air openings permit ink to be drawn into the head assembly and to the ink cups during use. The ink cups are configured to retain the ink by surface tension to prevent leakage of the ink through the nozzle openings.

The integrated circuit heater includes resistors positioned within the ink cups. The resistors are coupled with a source of electric energy and are kept at an EMF of 24 VDC. The ink cups retain the ink by surface tension until the source of electric energy causes the EMF to drop to about 12 VDC, which then causes the current to increase, heating the resistors. As the resistors are heated, the ink in the ink cups boils and is ejected through the nozzle openings for printing the indicia. The individual resistors may be selectively heated thousands of times per second for relatively precise ejection of ink resulting in relatively precise printing of indicia.

The process of heating and boiling the ink causes sediments and other material to become deposited in and around the nozzle openings and ink cups. As a result, the nozzle openings and ink cups eventually become sufficiently clogged so that the cartridge assembly is unusable. Dried ink is also deposited in and around the nozzle openings, clogging the openings.

Ink jet cartridge assemblies also utilize ink reservoirs to hold ink in an air tight chamber until being drawn into the print head assemblies. When ink is used and no further ink can be drawn to the print head assemblies ink residues remain in ink reservoirs which become sediment.

While several devices and methods are known to remove ink sediments and other debris from print head nozzle openings there appears to be a void related to cleaning the inside of sealed ink jet cartridge assemblies as well as ink paths and print head nozzle openings.

Several devices are known which inhibit the clogging of the nozzle openings. For example, it is known to provide a head washing device mounted on a printer unit for spraying water on the nozzle plate when the cartridge assembly is in the retraced, parked position. By washing the nozzle plate after each use, sediments and other deposited material are moved from the nozzle openings, increasing the operational life of the cartridge assembly. A cleaning solution has also been used to clean a nozzle plate when the cartridge assembly is in the parked position. This does not effect the inside aspects of the cartridge, including the ink reservoir foam pads.

Another known method and device which is known uses a source of steam. Exposing the print head nozzle openings to direct steam is claimed to soften sediments and other materials so they may be removed. On many cartridges, heat in excess of 160 degrees Fahrenheit will soften and damage the adhesive holding the nozzle plate to the print head assembly, thus rendering it useless. Again, this does not effect the inside aspects of the cartridge including the ink reservoir foam pads.

Another known method of cleaning a nozzle plate involves the use of gas such as air or nitrogen gas. Such gas is directed tangentially to the face of the nozzle plate once the cartridge assembly has returned to the parked position. The gas carries sediments and other deposited material away from the nozzle plate, thus increasing the operational life of the cartridge assembly. This does not effect the inside aspects of the cartridge including the ink reservoir foam pads and may disrupt delicate electronic assembly unites if sediment has hardened to them.

It is also known to provide a print head wiper positioned adjacent to the parked position of the cartridge assembly. As the cartridge assembly is returned to the parked position, the wiper removes sediment and other deposited material from the nozzle plate.

Once a cartridge assembly has reached the end of its operational life, either due to clogging of the nozzle openings or emptying of the ink reservoir, the cartridge assembly is removed from the printer unit and replaced by a fresh cartridge assembly. The spent cartridge assembly may then be returned to the manufacturer for recycling.

In a typical recycling process, the ink reservoir is emptied of any remaining ink, and the assembly is cleaned. Even when a cartridge assembly is used in conjunction with a head washing or cleaning device, some amount of sediment and other material will be deposited and hardened in and around the internal ink reservoir including foam pads, internal ink paths and the print head assembly during the operation of the cartridge assembly. Therefore, in a thorough recycling process, the internal ink reservoir including foam pads, internal ink paths and the print head assembly are to remove dried ink and other residue to permit fully operational cartridges following recycling.

Another method of cleaning cartridge assemblies includes the steps of positioning the nozzle plate in a cleaning solution for a short period of time, and wiping the plate to remove the sediments and other material. Once the nozzle plate is cleaned, the cartridge assembly is dried, refilled with ink and tested. Cartridge assemblies which do not meet certain predetermined standards of printing quality are discarded.

Although the cleaning methods available causes some of the sediments and other material deposited in and around the nozzle openings to be removed, many nozzle openings and ink cups remain sufficiently clogged so that the cartridge assemblies must be discarded. As a result, there is a significant and heretofore unsolved need to provide an improved method and apparatus of cleaning not only the nozzle plate of an ink jet cartridge assembly, but also the internal aspects of a cartridge assembly to remove sediments and other material deposited in and around the cartridge assembly which if not already at the nozzle openings, may later flow and "clot" the same and diminish or destroy cartridge performance.

BRIEF SUMMARY OF THE INVENTION

The present invention addresses the prior art problems noted above and provides significant advance in the state of the art of cleaning ink jet cartridge ink reservoir tank and foam pads, internal ink paths and print head including the nozzle plate assemblies. The present invention includes an improved method of cleaning an ink jet cartridge assembly and an apparatus for use in such a method.

The inventive method broadly combines the steps of preparing cartridges for optimum cleaning, using a simple vacuum chamber to fully impregnate a cartridge ink reservoir, including the foam pads therein, with cleaning solvent. Lowing the atmospheric pressure of heated solvent causes low temperature boiling action which internally agitates dried ink and other residue in ink reservoir foam pads, internal ink paths and the print head including nozzle plate assembly. Solution warmed at optimum temperature which fully impregnates otherwise sealed cartridge interior will also speed the return of dried ink and other residue to a liquid state for discharge.

Cartridges fully impregnated with solvent and ink residue and other sediments may be voided by centrifugal force without otherwise physically manipulating the sensitive and delicate cartridge components such as the ink reservoir foam pads and the print head including the nozzle plate assembly.

The invention also comprises an apparatus to uniquely permit the stated method to be accomplished optimally.

BRIEF DESCRIPTION OF DRAWINGS

While the present invention will hereinafter be described in connection with preferred embodiments thereof, it will be understood that it is not intended to limit the invention to that embodiment. On the contrary, it is intended to cover all alternatives, modifications, and equivalents thereof as may be included within the spirit and scope of the invention as defined by the appended claims.

DETAILED DESCRIPTION OF THE PREFERRED EMBODIMENT

Figure 1:
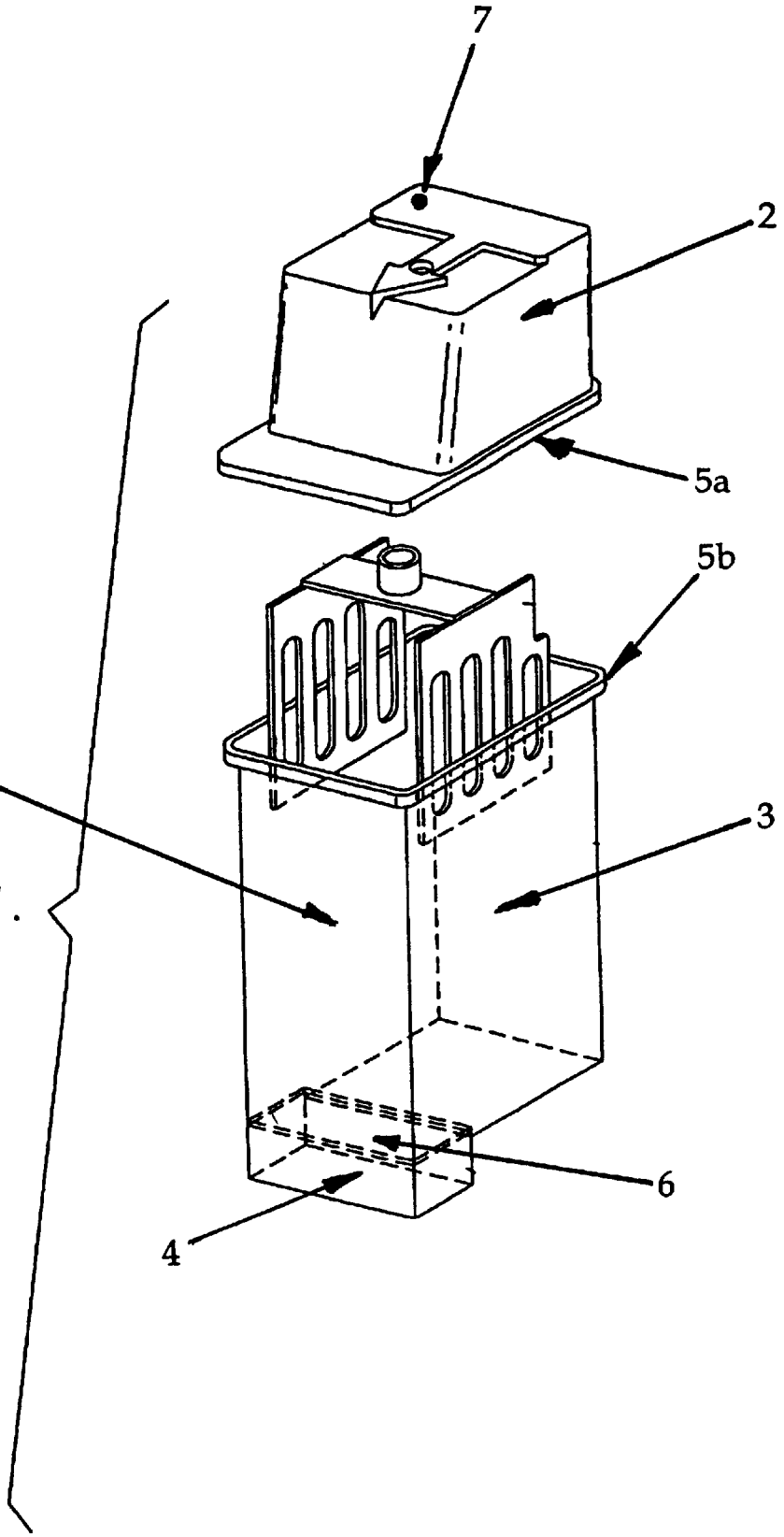
FIG. 1 is an exploded perspective view generally of an ink jet cartridge assembly.

Referring now to FIG. 1, an ink jet cartridge is shown generally as 1, shall be pre-prepared for remanufacture or recycling so as to expose the end opposite the print head assembly 4.

While black and color ink jet cartridges come in various shapes and sizes, all contain essentially the same basic physical components, generally consisting of cap 2, housing 3 which also serves as an ink reservoir 3, and a print head assembly unit 4. Cartridge 1 can be pre-prepared for remanufacture alternatively by one of four basic methods depending on the type of cartridge being remanufactured. First the cap 2 may be removed by cutting or breaking previously attached areas 5*a* and 5*b* otherwise joining the cap 2 and the housing 3. A second method of pre-preparing cartridges for remanufacture is to drill hole at top of cap 2 over each different color chamber of a color cartridge (not shown) where cap 2 and housing 3 are not severed and are, in fact, one and the same. A third method pre-preparing cartridges for remanufacture is to drill a hole in lateral plane of ink well reservoir 3 opposite electronic circuitry and directly above print head nozzle plate 6 as well as drilling hole in top surface of cap 2. A fourth method of pre-preparing cartridges for remanufacture is to remove vent plugs 7 (if existing) in cap 2.

Pre-prepared cartridges shall be placed into vacuum chamber.

Figure 2A:
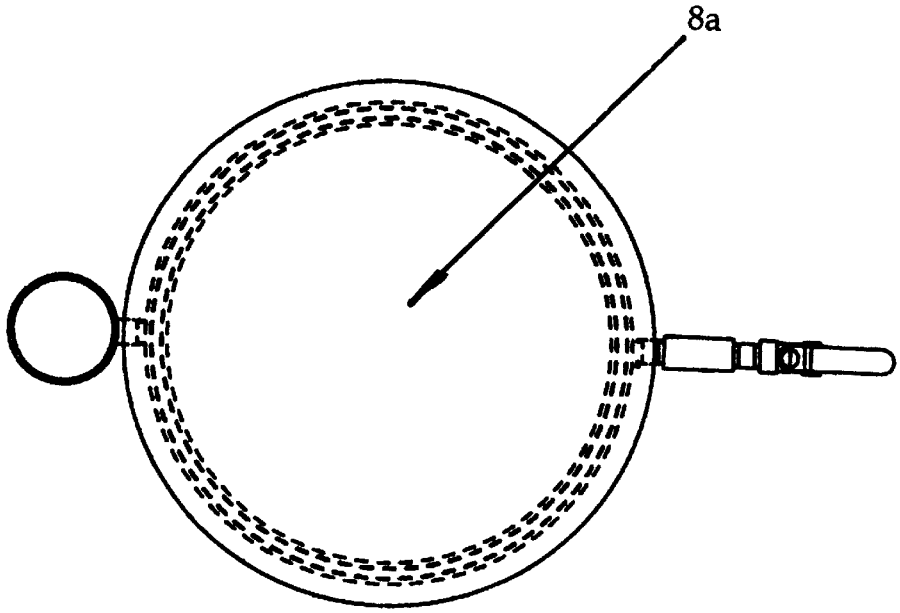
FIGS. 2A & 2B are sectional elevational views the top and side view respectively of the vacuum chamber subapparatus showing various features thereof.
Figure 2B:
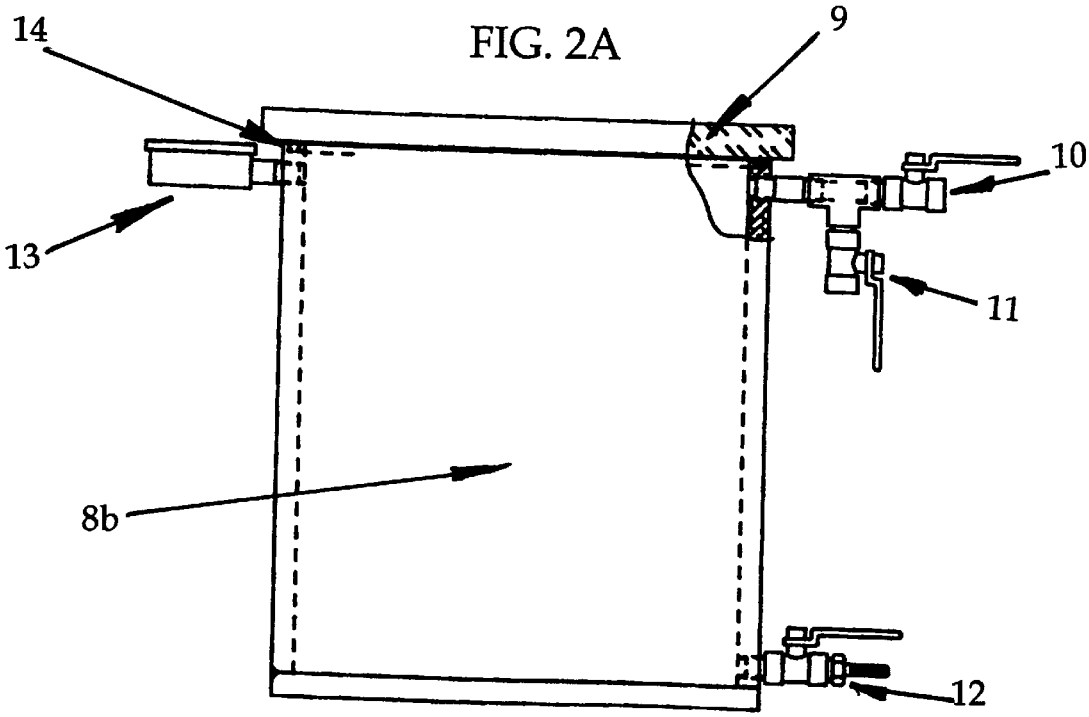

Referring now to FIGS. 2A & 2B, pre-prepared cartridges shall be placed into vacuum chamber 8*a* and 8*b*.

Figure 3A:
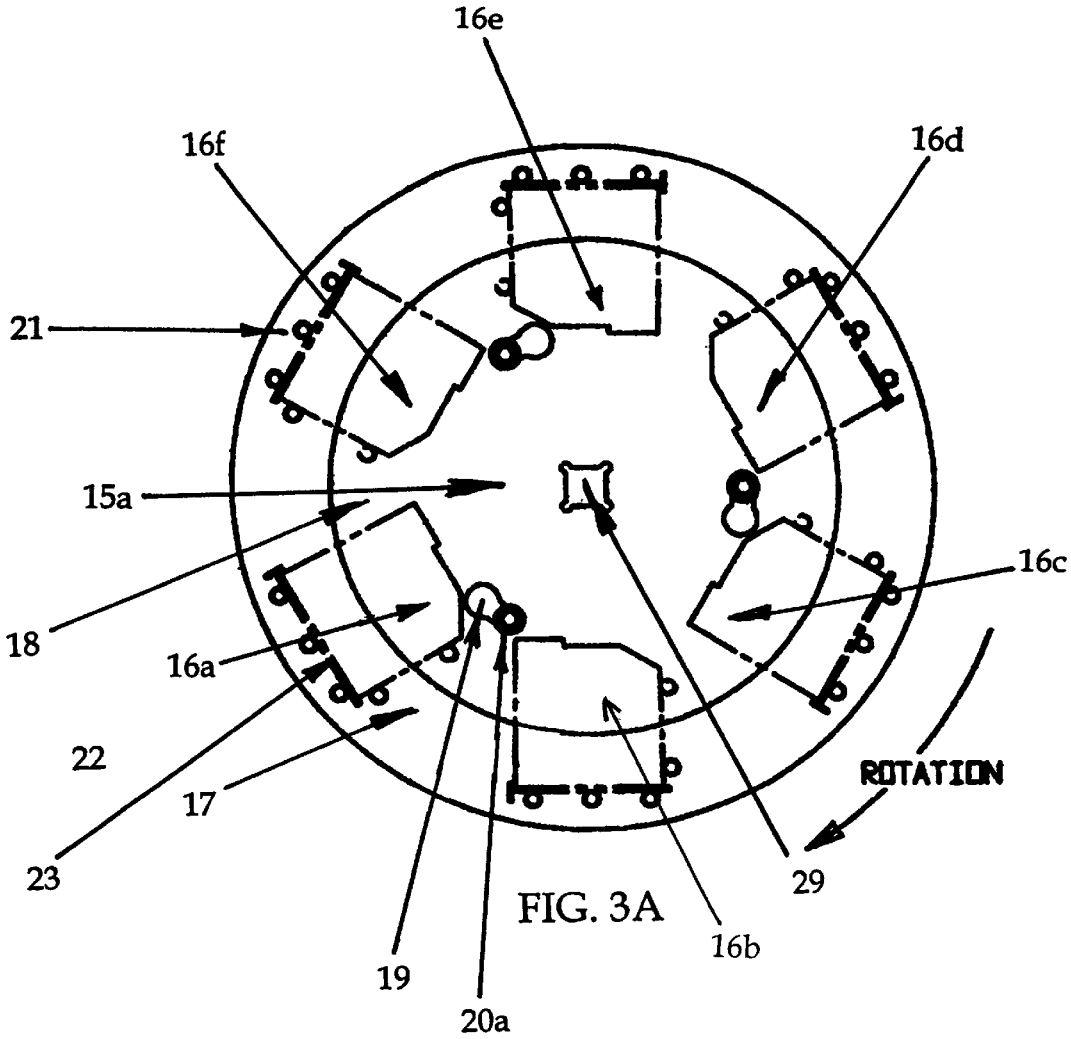
FIGS. 3A & 3B are sectional elevational views of the top and side view respectively of the cartridge plate assembly units showing various features thereof.
Figure 3B:
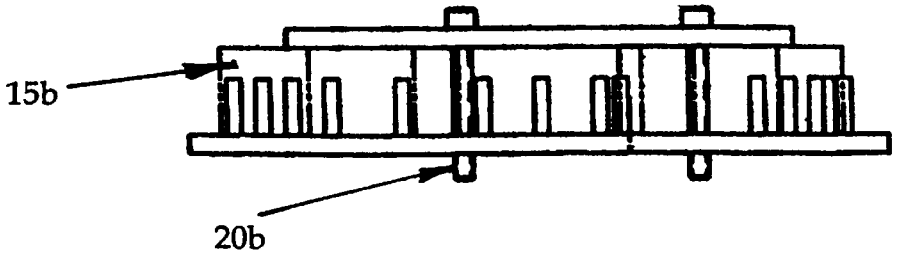

Cartridges may be placed loose in vacuum chamber 8*a* and 8*b*, but preferably, the cartridges shall be secured to the cartridge plate assembly 15*a* and 15*b* as shown in FIGS. 3A & 3B.

Pre-prepared cartridges 16 shall be placed on base plate 17 with cartridge print heads 22 to center and cap 2 away from center. Blocking pins 21 are placed to prevent cartridge 16 and/or its exposed foam pads (not shown) from movement away from center of base plate 17.

A cover plate 18 shall be centered over base plate 17 using cover plate support thumb screws 20*a* and 20*b* which are slid into thumb screw slot 19. Thumb screws 20*a* and 20*b* are then tightened to sandwich cartridges 16 securely between base plate 17 and cover plate 18. The assembly of base plate 17, cover plate 18 and cartridges 16 as secured together comprise the cartridge plate assembly unit 15*a* and 15*b*.

The cartridge plate assembly unit 15*a* and 15*b* is then placed with the base plate 17 most downwardly into the vacuum chamber 8*a* and 8*b* additional cartridge plate assembly units 15*a* and 15*b* as will be accommodated in vacuum chamber 8*a* and 8*b*.

Water or other liquid solvent "solvent" is then introduced to fill vacuum chamber 8*a* and 8*b* in an amount equal to that which will cause all cartridge plate assembly units 15*a* and 15*b* to be submerged and additionally an amount at least equal to at least the volume of air trapped in all empty cartridges 16.

Prior to introduction into vacuum chamber 8*a* and 8*b* solvent is preheated to temperature that when combined with the reduced atmospheric pressure available in vacuum chamber 8*a* and 8*b* causes the solvent to perform a boiling action.

Optimally, the temperature of the solvent should be as close to 140° Fahrenheit as possible, but at least between 100 and 160 degrees Fahrenheit.

Immediately, the vacuum chamber 8*a* and 8*b* is secured with airtight seal 14.

Mechanical vacuum pump (not shown) is then initiated to reduce atmospheric pressure in vacuum chamber 8*a* and 8*b* to a level that when combined with the temperature of the solvent causes the solvent to begin a boiling action. Simultaneously, air trapped in the cartridges 16 shall be immediately displaced by solvent.

The solvent in the vacuum chamber 8*a* and 8*b* should be allowed to boil for a short period of time. Optimal boiling period should last five minutes. Then the vacuum chamber 8*a* and 8*b* shall be returned to atmospheric pressure by opening release valve 11 and permitting ambient air to enter vacuum chamber 8*a* and 8*b*.

The sub-process of reducing the atmospheric pressure within the vacuum chamber 8*a* and 8*b* to point of boiling and holding in such state for a short period can be repeated several times to ensure more thorough agitation and cleaning within the cartridge housing 16 and print head assembly unit 22.

After completion of sub-process using vacuum chamber 8*a* and 8*b*, cartridge plate assembly units 15*a* and 15*b* are individually removed.

Figure 4A:
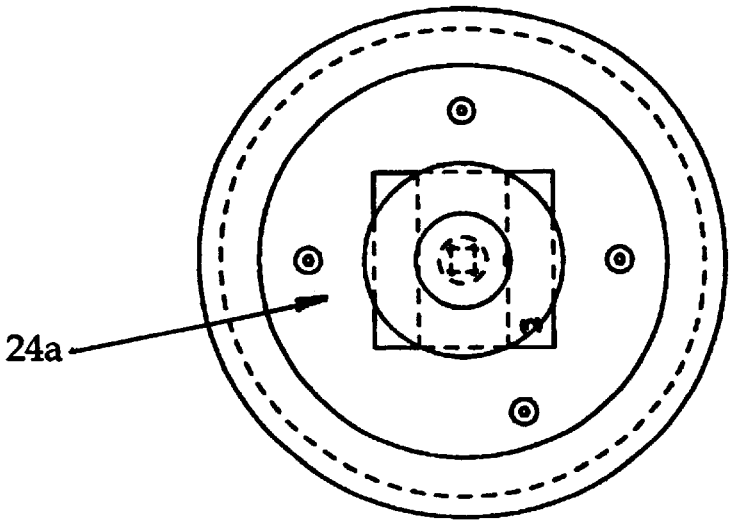
FIGS. 4A & 4B are sectional elevational views of the top and side view respectively of the centrifugal chamber subapparatus showing various features thereof.
Figure 4B:
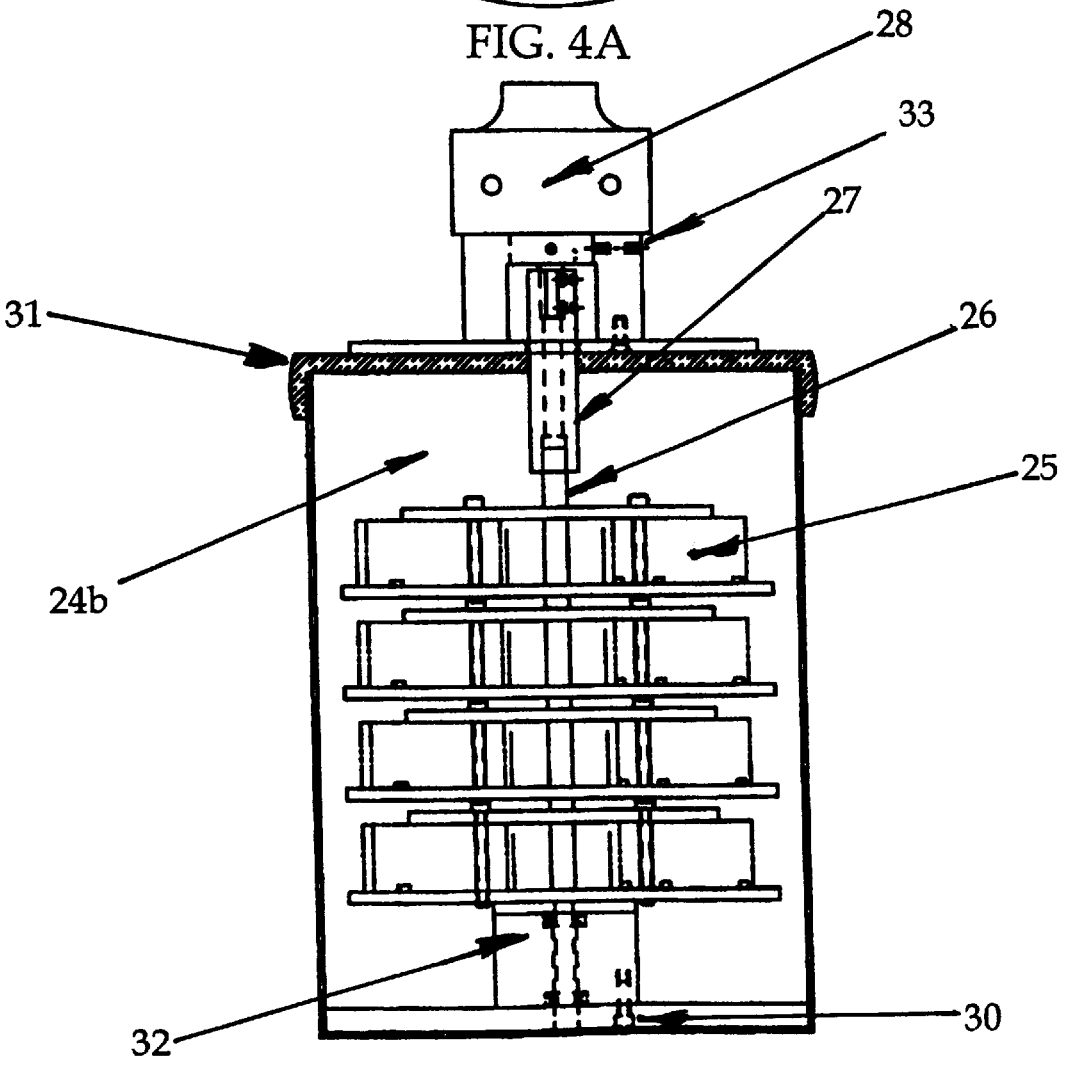

Referring now to FIGS. 4A & 4B, cartridge plate assembly unit 25*a* and 25*b* are placed into centrifuge chamber 24*a* and 24*b* with center square hole of cartridge plate assembly unit 25*a* and 25*b* mated directly over square centrifuge spindle 26 with base plate 17 most downwardly. The cartridge plate assembly unit 25 is then slid into centrifuge chamber 24*a* and 24*b* with centrifuge spindle 26 penetrating through all cartridge plate assembly units 25 and extending above all plates to mate with mechanical device 28 used to rotate centrifuge spindle 26 and attached cartridge plate assembly unit 25. Additional cartridge plate assembly units 25 may be placed contiguously with other cartridge plate assembly units 25 with each center penetrated by the centrifuge spindle 26 until centrifuge chamber 24*a* and 24*b* is full.

The centrifuge chamber 24*a* and 24*b* is sealed with centrifuge spindle 26 available to mate with mechanical device 28 to cause the centrifuge spindle 26 and attached cartridge plate assembly units 25 to rotate in a clockwise direction until centrifugal force causes all solvent and ink residue to be removed from the cartridges 16. Waste solvent and ink residue accumulates by force of gravity at bottom of centrifuge chamber 24*a* and 24*b* in base 32 with Teflon sleeve and vacated by drain opening 30.

Process may be repeated once or more to improve cleaning results but with a substantially diminished marginal rate of return.

Figure 5:
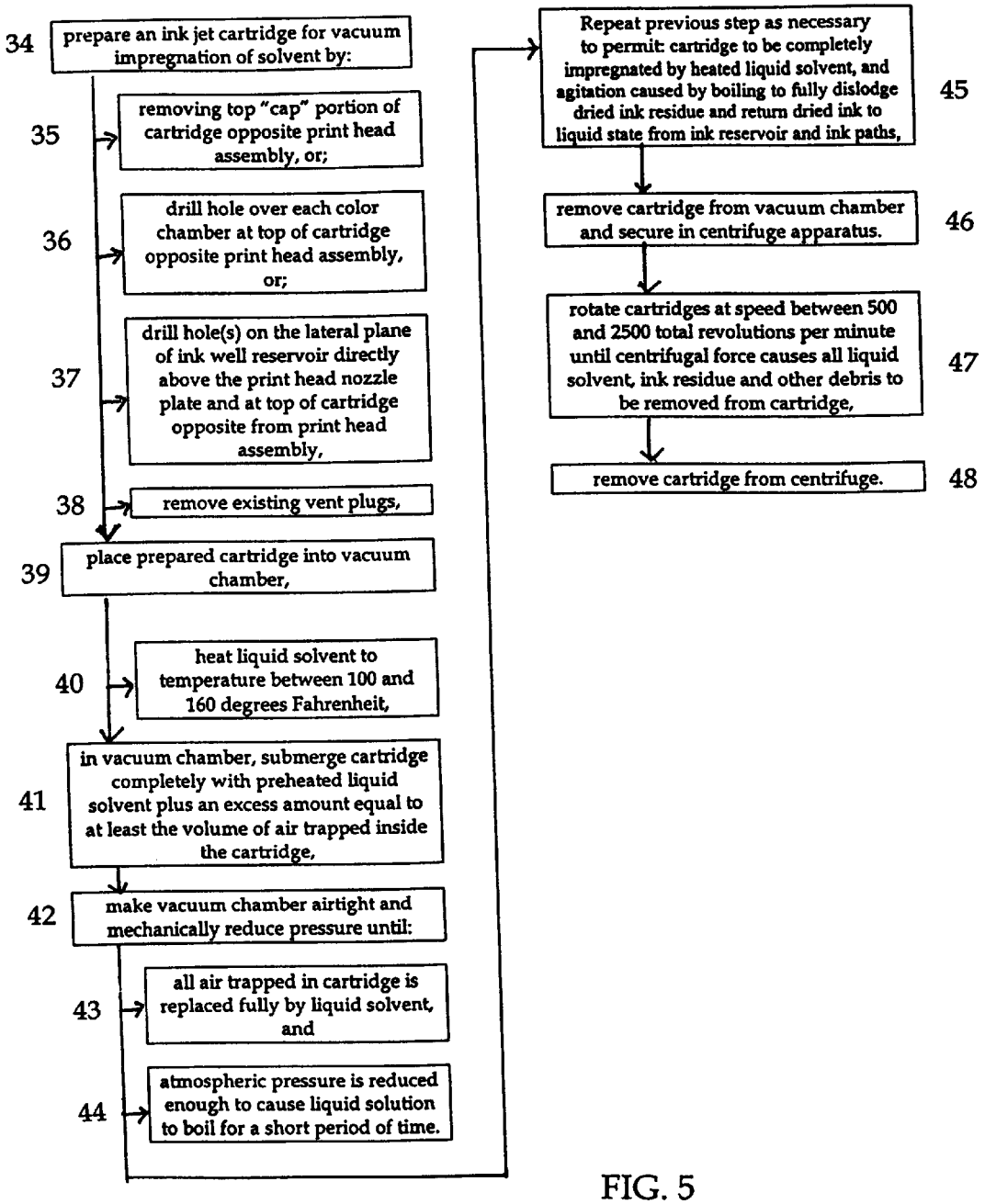
FIG. 5 is a flow chart showing the method for cleaning ink jet cartridges in accordance with the invention method and apparatus.

The methodology is generally illustratively represented by flowchart. Now referring to FIG. 5 the steps involved should be followed to ensure intended outcome 34, 35, 36, 37, 38, 39, 40, 41, 42, 43, 44, 45, 46, 47 and 48.

What is claimed is:

1. A method for removing dried ink and other residue from the inside of an ink jet printing cartridge reservoir, ink paths and a print head assembly of an ink cartridge in preparation for remanufacturing/recycling, wherein said cartridge includes a top cap portion opposite said print head assembly, said print head assembly includes a print head nozzle plate, said cartridge may include a plurality of color chambers and/or vent plugs, the method comprising the steps of:

a. preparing said ink jet cartridge for vacuum impregnation of solvent by:
   1. removing said top cap portion of said cartridge, or
   2. drilling a hole over each color chamber at said top cap portion, or
   3. drilling a hole on a lateral plane of said cartridge reservoir directly above the print head nozzle plate and at said top cap portion, or
   4. removing the existing vent plugs, b. placing the prepared cartridge into a vacuum chamber, c. preheating a liquid solvent to a temperature between 100 and 160 degrees Fahrenheit, d. in said vacuum chamber, submerging said cartridge completely with the preheated liquid solvent plus an excess amount of the preheated liquid solvent equal to at least the volume of air trapped inside the cartridge, e. sealing said vacuum chamber airtight and mechanically reducing pressure until:
   1. all air trapped in said cartridge is replaced fully by the liquid solvent, and
   2. atmospheric pressure is reduced enough to cause the liquid solvent to boil for a short period of time, and permitting ambient air to enter the vacuum chamber so that the vacuum chamber return to atmospheric pressure, f. repeating step (e) as necessary to permit:
   1. the cartridge to be completely impregnated by the heated liquid solvent, and
   2. agitation caused by boiling to fully dislodge dried ink residue and return dried ink to liquid state from said ink cartridge reservoir and said ink paths, g. removing said cartridge from said vacuum chamber and securing said cartridge in a centrifuge apparatus, h. rotating said cartridge at a speed between 500 and 2500 total revolutions per minute until a centrifugal force causes all liquid solvent, ink residue and other debris to be removed from said cartridge, and i. removing said cartridge from said centrifuge apparatus.

* * * * *